US005666884A

United States Patent [19]

Lopez Alba

[11] Patent Number: 5,666,884

[45] Date of Patent: Sep. 16, 1997

[54] OVERHEAD VEHICLE HAVING SPRING-BIASED, RAIL-URGED LEVER-MOUNTED GUIDE WHEEL FOR ELECTRICALLY POWERED DRIVE WHEEL

[75] Inventor: Adelardo Lopez Alba, Poligono Industrial Sur, 08754 El Papiol (Barcelona), Spain

[73] Assignee: Adelardo Lopez Alba, Barcelona, Spain

[21] Appl. No.: 606,041

[22] Filed: Feb. 16, 1996

[30] Foreign Application Priority Data

Feb. 16, 1995 [ES] Spain ..... 9500436

[51] Int. Cl.[6] ..... B61C 11/00

[52] U.S. Cl. ..... 105/30; 105/73; 105/147

[58] Field of Search ..... 105/30, 73, 75, 105/147, 150, 215.1; 104/89, 93, 121, 163, 165, 243

[56] References Cited

U.S. PATENT DOCUMENTS

| | | | |
|---|---|---|---|
| 1,801,141 | 4/1931 | Connors | 105/147 |
| 2,709,968 | 6/1955 | Cox | 105/30 |
| 3,254,608 | 6/1966 | Alden | 104/89 |
| 5,092,249 | 3/1992 | Knuettel | 105/73 |
| 5,331,900 | 7/1994 | Gersemsky | 105/73 |

FOREIGN PATENT DOCUMENTS

| | | | |
|---|---|---|---|
| 384223 | 8/1990 | European Pat. Off. . | |
| 371131 | 2/1922 | Germany | 105/147 |

*Primary Examiner*—S. Joseph Morano
*Attorney, Agent, or Firm*—Cushman Darby & Cushman IP Group of Pillsbury Madison & Sutro LLP

[57] ABSTRACT

A vehicle travels along a rail and, driven by an onboard motor. The vehicle includes an auxiliary guide wheel mounted in a floating arrangement on a component acted upon by a helical spring. A shaft on which the wheel is mounted is disposed in an elongated slot in a lever. The lever is articulated at a place on the vehicle body and its other end is acted upon by a second spring. Rotation of the lever is limited by a stop which is secured to the vehicle. When the auxiliary guide wheel makes contact with the guide rail, the two springs are compressed, so that the two wheels touch. Consequently, contact between the outer peripheral surfaces of the two wheels occurs only when the vehicle is moving underneath the guide rail. At other times during operation, there is no contact and no wear on the material forming the outer peripheral surfaces of the two wheel.

1 Claim, 1 Drawing Sheet

OVERHEAD VEHICLE HAVING SPRING-BIASED, RAIL-URGED LEVER-MOUNTED GUIDE WHEEL FOR ELECTRICALLY POWERED DRIVE WHEEL

BACKGROUND OF THE INVENTION

This invention relates to an electric vehicle,and in particular to an overhead-powered self-propelled vehicle actuated by an electric motor.

The vehicle described hereinafter is intend to form part of overhead transport systems such as those used in industrial establishment for manufacture of vehicles, machines and apparatus of various kinds, where successive motion of parts, components and sub-assemblies is required in given circuits belonging to assembly lines, machining or assembly stations or the like.

there are various known kinds of self-propelled vehicles, usually with a driving wheel associated with a propelling motor and travelling along a rail or track,an auxiliary wheel being provided for making contact with a guide section member, so that when the two wheels touch and are in contact, the vehicle moves in a guided manner on and along the track.

An example of the aforementioned device is described in European patent Noumber 0 384 223.

However, the aforementioned system and other similar systems have the disadvantage that continual touching and contact between the two wheels (the driving wheel and the guide wheel) result in wear on the material forming the surface of the wheels, which leads to irregularities in the motion of the vehicle and necessitates a periodic change of wheels in order to remedy these defects. This increases the cost of maintenance of the transport installation.

SUMMARY OF THE INVENTION according to the present invention, there is provided a vehicle actuated by an electric motor, of the kind comprising a driving wheel traveling along a supporting rail and a guide wheel associated with a co-operating guide rail, characterised in that the auxiliary guide wheel, on a shaft which is movable relative to the shaft of the driving wheel, is mounted on the end of an elongate component in a floating arrangement and acted upon by a spring, the aforementioned shaft being movable along a slot formed in a longitudinal lever articulated at one end to a place on the vehicle and constantly thrust upwards by a second spring tending to separate the two side surfaces of the two wheels, the angular rotation of the lever being limited by an upper stop secure to the vehicle.

The self-propelled vehicle according to the Present invention vehicle ameliorates the aforementioned disadvantage by being designed so that contact between the two wheels occurs only when the guide wheel makes contact with the cooperating guide section member, whereas in the absence of such contact the two wheels are separate and consequently without mutual friction, thus considerably prolong the life of the outer surface of each wheel.

BRIEF DESCRIPTION OF THE DRAWINGS

For a better understanding of the present invention, and to show how it may be carried into effect, reference shall now be made, by way of example, to the accompanying drawings, in which.

Figure 1:
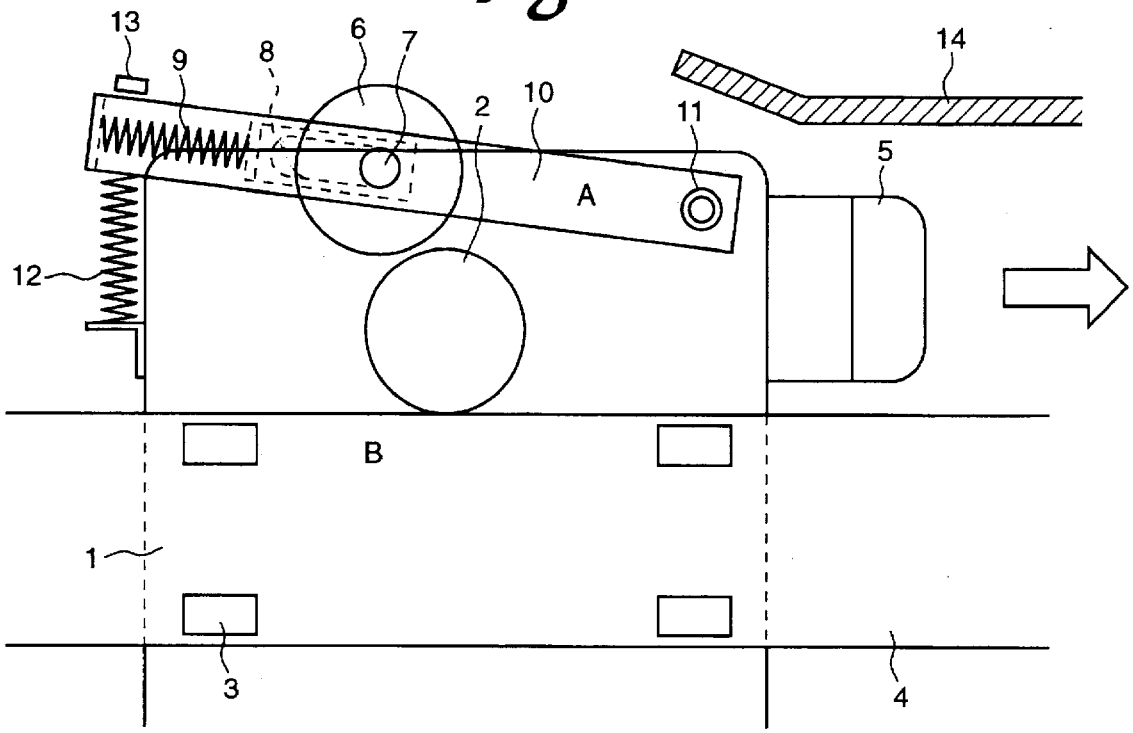
FIG. 1 shows the novel self-propelled vehicle in a position separate from the co-operating guide and consequently with he two wheels apart.

The components denoted by reference numbers in the drawing correspond to the parts referred to hereinafter.

DETAILED DESCRIPTION

A self-propelled vehicle 1 provided with a driving wheel 2 comprises guide mean 3 associated with an electrified rail 4 on which the vehicle moves, driven by a coupling device (not shown) comprising an electric motor 5 associated with the vehicle and provided with a reduction gear.

The auxiliary device for guiding the vehicle in uniform motion comprises a wheel 6 having the same diameter as the wheel 2 and a side surface coated with a given material having a suitable coefficient of adhesion. The wheel 6 rotates freely relative to its shaft 7, which also rotates freely and is disposed at the end of an elongate component 8 in a floating arrangement and acted upon by a spring 9 or similar resilient element.

The shaft 7 of the wheel 6 is disposed in the interior of a slot formed in a straight lever 10 which rotates around a place 11 fixed by a bolt secured to the vehicle 1.

The head of a spring 12 or similar resilient element bears against the end of the lever 10 and tends to raise its free end, the angular motion of the lever being limited by a fixed stop 13 secured to the vehicle, whereas the foot of the spring 12 bears against a bracket or projection, likewise secured to the vehicle.

Under these conditions, when the vehicle 1 in FIG. 1 is at a remote position or separate from the rail 14 constituting a co-operating guide, the spring 12 raises the lever 10 and consequently separates the wheels 2 and 6 as in FIG. 1.

Figure 2:
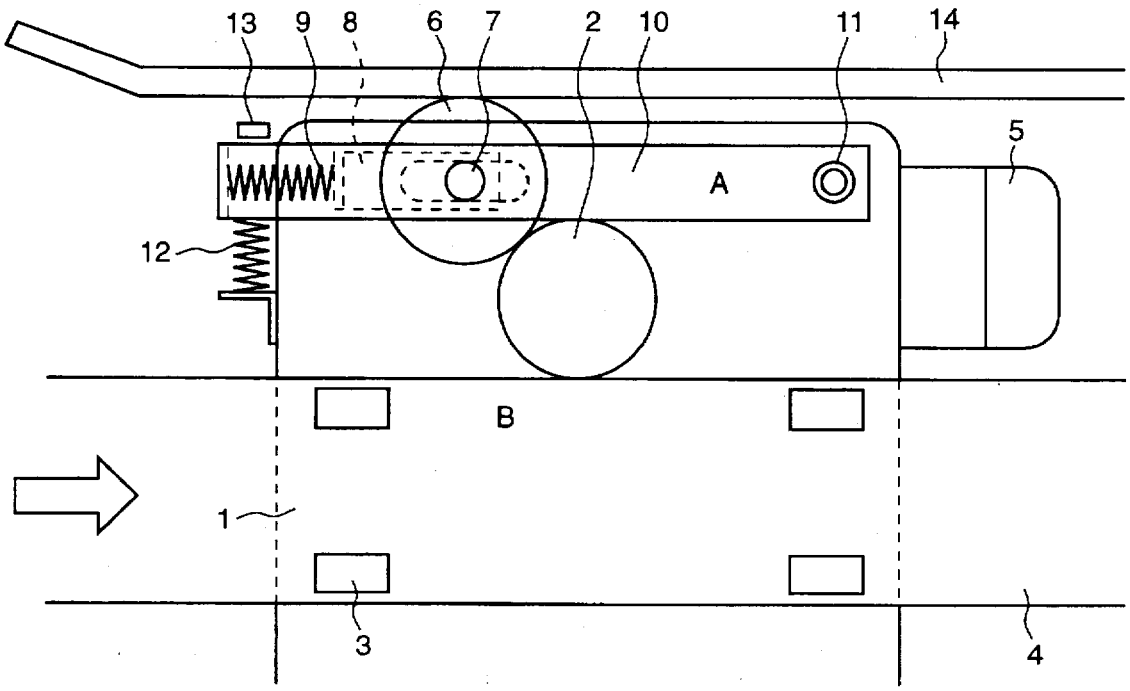
FIG. 2 shows the vehicle in a position of contact with the co-operating guide and contact through touching between the two wheels.

When the vehicle, during its travel in the direction of the arrow, occupies a position underneath the section member 14 as in FIG. 2, the wheel 6 approaches the wheel 2 until the two touch and make contact, overcoming the lifting force of the spring 12 which is temporarily compressed, like the spring 9. Consequently contact between the wheels occurs only at the periods when necessary, i.e. when the vehicle is moving underneath the co-operating guide.

The invention, in accordance with its essential features, can be put into practice in embodiments differing in detail from that given by way of example in the preceding description, the other embodiments likewise having the protection which is claimed. Also the novel vehicle can be constructed in any form and size and from the most suitable materials, while remaining within the spirit of the following claims.

I claim:

1. A vehicle actuated by an electric motor, comprising:

a vehicle body, a driving wheel journalled on a first shaft mounted to said vehicle body for travelling along a supporting rail and an auxiliary guide wheel associated with a cooperating guide rail, said driving wheel and auxiliary guide wheel having respective outer peripheral surfaces, said auxiliary guide wheel being journalled on a second shaft which is movable relative to said first shaft of the driving wheel, said auxiliary guide wheel being mounted on one end of a longitudinal lever articulated at an opposite end to said vehicle body in a floating arrangement, and acted upon by a spring, said second shaft being movable longitudinally of said longitudinal lever along a slot formed in said longitudinal lever, said second shaft being constantly thrust upwards by a second spring tending to separate the outer peripheral surfaces of said wheels from one another, angular rotation of said lever being limited by an upper stop secured to said vehicle body.

* * * * *